US005240328A

United States Patent [19]

Krambrock

[11] Patent Number: 5,240,328

[45] Date of Patent: Aug. 31, 1993

[54] APPARATUS FOR MIXING POWDERED OR COARSE-GRAINED BULK MATERIALS

[75] Inventor: Wolfgang Krambrock, Vogt, Fed. Rep. of Germany

[73] Assignee: AVT Anlagen- und Verfahrenstechnik GmbH, Weingarten, Fed. Rep. of Germany

[21] Appl. No.: 732,221

[22] Filed: Jul. 19, 1991

[30] Foreign Application Priority Data

Jul. 26, 1990 [DE] Fed. Rep. of Germany ..... 4023754
Oct. 31, 1990 [DE] Fed. Rep. of Germany ..... 4034616

[51] Int. Cl.[5] ..... B01F 13/00
[52] U.S. Cl. ..... 366/341; 366/9
[58] Field of Search ..... 366/341, 177, 178, 181, 366/183, 336, 134, 131, 154, 179, 9

[56] References Cited

U.S. PATENT DOCUMENTS

| | | | |
|---|---|---|---|
| 3,158,362 | 11/1964 | Seifarth | 366/177 |
| 3,268,215 | 8/1966 | Burton | 366/177 |
| 3,273,864 | 9/1966 | Thomson . | |
| 3,275,303 | 9/1966 | Goins | 366/341 |
| 3,351,326 | 11/1967 | Alberts et al. | 366/134 |
| 3,912,232 | 10/1975 | Gmuer | 366/108 |
| 3,936,037 | 2/1976 | Lenard, Jr. | 366/177 |
| 4,553,849 | 11/1985 | Goins | 366/341 |
| 4,818,117 | 4/1989 | Krambrock . | |
| 4,978,228 | 12/1990 | Wilms | 366/341 |

FOREIGN PATENT DOCUMENTS

| | | | |
|---|---|---|---|
| 1432025 | 1/1969 | Fed. Rep. of Germany . | |
| 1507885 | 9/1971 | Fed. Rep. of Germany . | |
| 2819726 | 11/1979 | Fed. Rep. of Germany . | |
| 3512538 | 6/1986 | Fed. Rep. of Germany . | |
| 3707264 | 9/1987 | Fed. Rep. of Germany . | |
| 1566029 | 5/1969 | France . | |
| 0530738 | 7/1955 | Italy | 366/341 |
| 2196546 | 5/1988 | United Kingdom | 366/336 |

*Primary Examiner*—Harvey C. Hornsby
*Assistant Examiner*—Tony G. Soohoo
*Attorney, Agent, or Firm*—Spencer, Frank & Schneider

[57] ABSTRACT

An apparatus for mixing powdered or coarse-grained bulk materials includes a first mixing device (4) with a second mixing device (11) lying below it, each of them having cylindrical mixing containers (2, 12) with downward tapering mass flow hoppers (3, 13). The bulk material from the upper mixing device (4) is conveyed via gravity pipes (9, 10, 10', 28, 29) into the second mixing device (11), which concentrically surrounds a third mixing device (6). Outlet apertures (27) are provided in the third mixing device (6) to ensure a constant discharge mass flow through the total lower outlet area (25).

9 Claims, 2 Drawing Sheets

APPARATUS FOR MIXING POWDERED OR COARSE-GRAINED BULK MATERIALS

BACKGROUND OF THE INVENTION

The invention relates to an apparatus for mixing powdered or coarse-grained bulk materials or solids, and more particularly to a mixing apparatus of the type that includes an upper or first mixing device, a lower or second mixing device connected to the bottom of the first mixing device, and concentrically arranged gravity pipes which convey bulk material from different levels of the first mixing device to the second mixing device.

STATE OF THE ART

The different types of mixing devices and the ways in which they work are described in, for example, DE-A1-3,512,538 (Krambrock). Express reference is made to the content of this publication.

Particular reference is made to the different modes of operation for the discharge of bulk materials from containers where so-called "core flow" or "mass flow" can occur. Various measures for achieving an optimum mixing effect are described in DE-A1-3,512,538 with further references to literature.

DE-A1-1,507,885 (Burton), FR-PS 1,566,029 and DE-A1-3,707,264 (Krambrock) disclose further measures which lead to a uniform outflow from the bulk material container. In order to achieve a mixing effect, gravity pipes in particular are arranged in the interior of the mixing container, said pipes having inlet apertures at different heights for bulk material. The distribution of the inlet apertures and the cross-sections of the gravity pipes are in this case selected in such a way that bulk material is constantly removed from different levels of the mixing container, and is discharged at different speeds and fed back in again above the outlet of the container. This produces uniform mixing of the bulk material introduced into the mixer, the composition of which may vary.

If several inlet apertures for bulk material are present in one gravity pipe, only the inlet apertures nearest to the surface of the bulk material are constantly operative until the material supply through these inlet apertures corresponds to the material discharge from the gravity pipe. The bulk material passes out of the mixer through these bulk material apertures which are active at the time into the gravity pipe, and fills the gravity pipe completely with bulk material. No additional bulk material can then flow through any of the inlet apertures of this gravity pipe lying below that. These bulk material apertures lying lower down do not become operative until the bulk material apertures above them lie above the level of the bulk material and no further bulk material can flow in through these bulk material apertures.

The gravity pipes lying outside the lower outlet cross-section of the mixing container in DE-AS-1,507,885 have to be conveyed back into the mixer laterally above the outlet of the mixer. For this, a further cylindrical or prismatic container with hopper attachment into which the gravity pipes open is used. When all gravity pipes have run empty, bulk material is then conveyed only above the central outlet of the upper mixing container, i.e. the total mass flow is greatly reduced.

Static mixers of known designs consequently have removal pipes arranged outside or inside which are provided with bulk material inlet apertures at various heights. In this case the ratio of an annular area formed around a central outlet of the mixing container to the area of the central outlet itself can correspond to the area ratio of all removal pipes to the area of a single removal pipe, i.e. the central outlet behaves like a single gravity pipe.

All known devices have the common factor that in gravity pipes which are no longer active the product mass flow is reduced to the remaining quantity of the central outlet. However, this remaining quantity is only a fraction of the desired total mass flow from the mixing device.

SUMMARY OF THE INVENTION

The arrangement according to the invention is characterized in that connected downstream of the hopper outlet of the upper mixing device is a further, third inner mixing device, which comprises an upper cylindrical or prismatic discharge compartment and a downward tapering mass flow hopper connecting thereto and which is preferably concentrically surrounded by the second, outer mixing device; and in that the discharge compartment of the third mixing device has on its cylindrical surface outlet apertures which are arranged below the lowest gravity pipe outlet aperture into the second mixing device and from which bulk material flows when the outer discharge compartment of the second mixing device is not completely loaded with bulk material from the gravity pipes, the bulk material in all three mixing devices dropping uniformly downwards in each cross-section (mass flow). In such an arrangement the advantages of the different known systems are combined, but without retaining any possible disadvantages. It is therefore particularly advantageous to select the arrangement of an upper first mixing container for mass flow with connecting discharge hopper, to the lower outlet of which an inner container (3rd container) with accompanying discharge hopper is connected, while the gravity pipes open into an outer mixing container (2nd container) surrounding the inner mixing container concentrically.

If then the gravity pipes have run partially empty because of the falling level of the bulk material, only a reduced mass flow would take place through the annular area of the second, outer mixing device for the gravity pipes. If the gravity pipes have run completely empty, the total mass flow would be determined only by the smaller hopper aperture of the discharge hopper of the third, inner mixing device, i.e. the surrounding annular outlet cross-section of the second, outer mixing device would remain empty and unused. According to the invention, additional outlet apertures are therefore provided in the cylindrical surface of the discharge compartment of the lower, third, inner mixing device, from which apertures bulk material can then flow into the surrounding discharge compartment of the second, outer mixing device for the gravity pipes, if this compartment is not completely filled with bulk material from the gravity pipes, so that again the full lower cross-section of the overall mixing apparatus is used as an outflow area and an undiminished total mass flow can flow out. As long as the outer discharge compartment for the gravity pipes is filled completely with bulk material by the latter, no material can flow out of these additional apertures of the inner mixing device. The arrangement according to the invention consequently means that the entire lower outlet cross-section of the device is always used.

DESCRIPTION OF THE PREFERRED EMBODIMENTS

Figure 1:
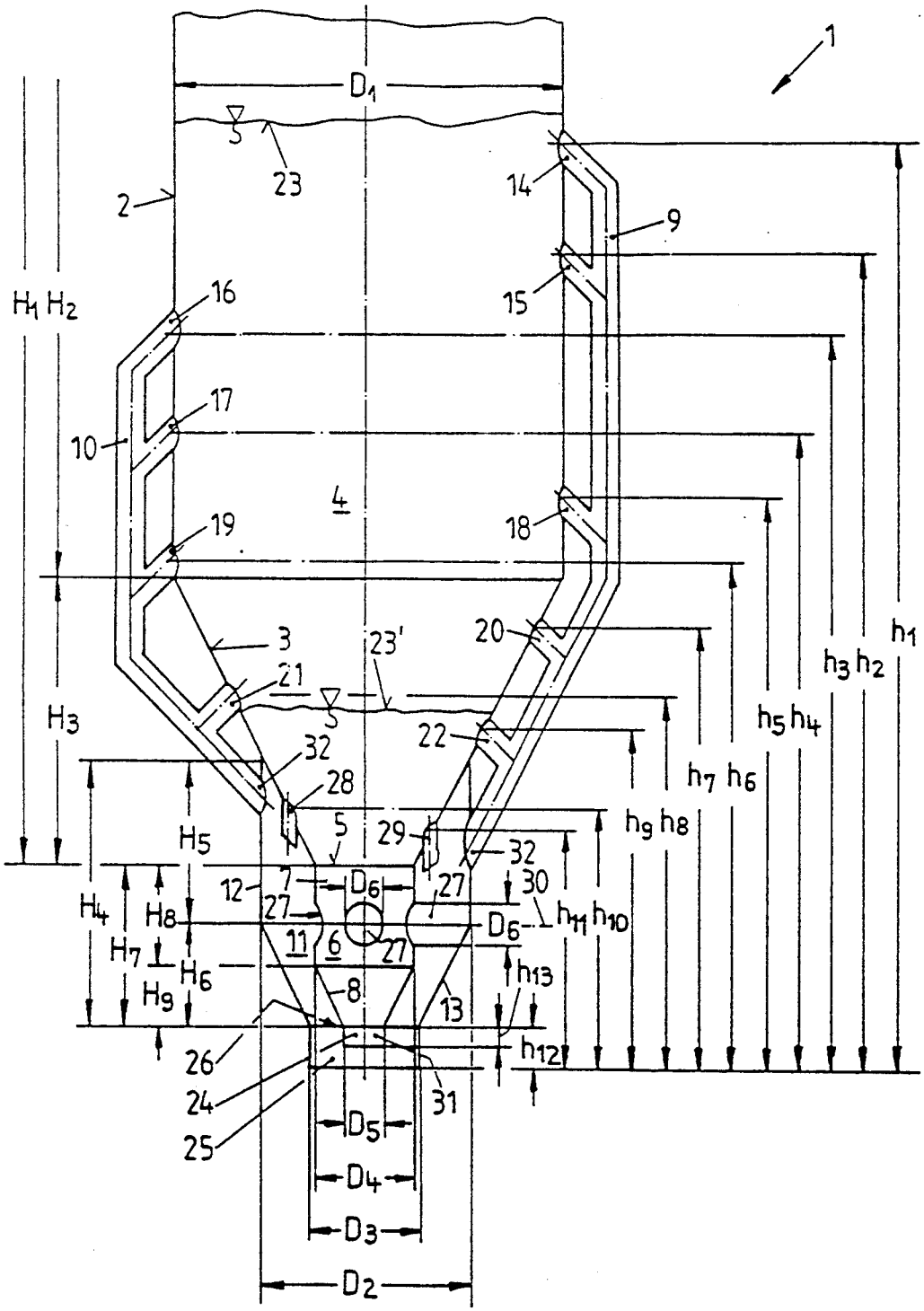
FIG. 1 shows a schematic view of the apparatus according to the invention in longitudinal section, with outside gravity pipes.

The apparatus 1 according to the invention shown in FIG. 1 comprises an upper cylindrical or prismatic mixing container 2 for bulk material, with height $H_2$, and a discharge or flow hopper 3 with height $H_3$ connecting in the lower region of the mixing container 2. The mixing container 2 and the mass flow hopper 3 form a first mixing device 4 with overall height $H_1$.

Figure 2:
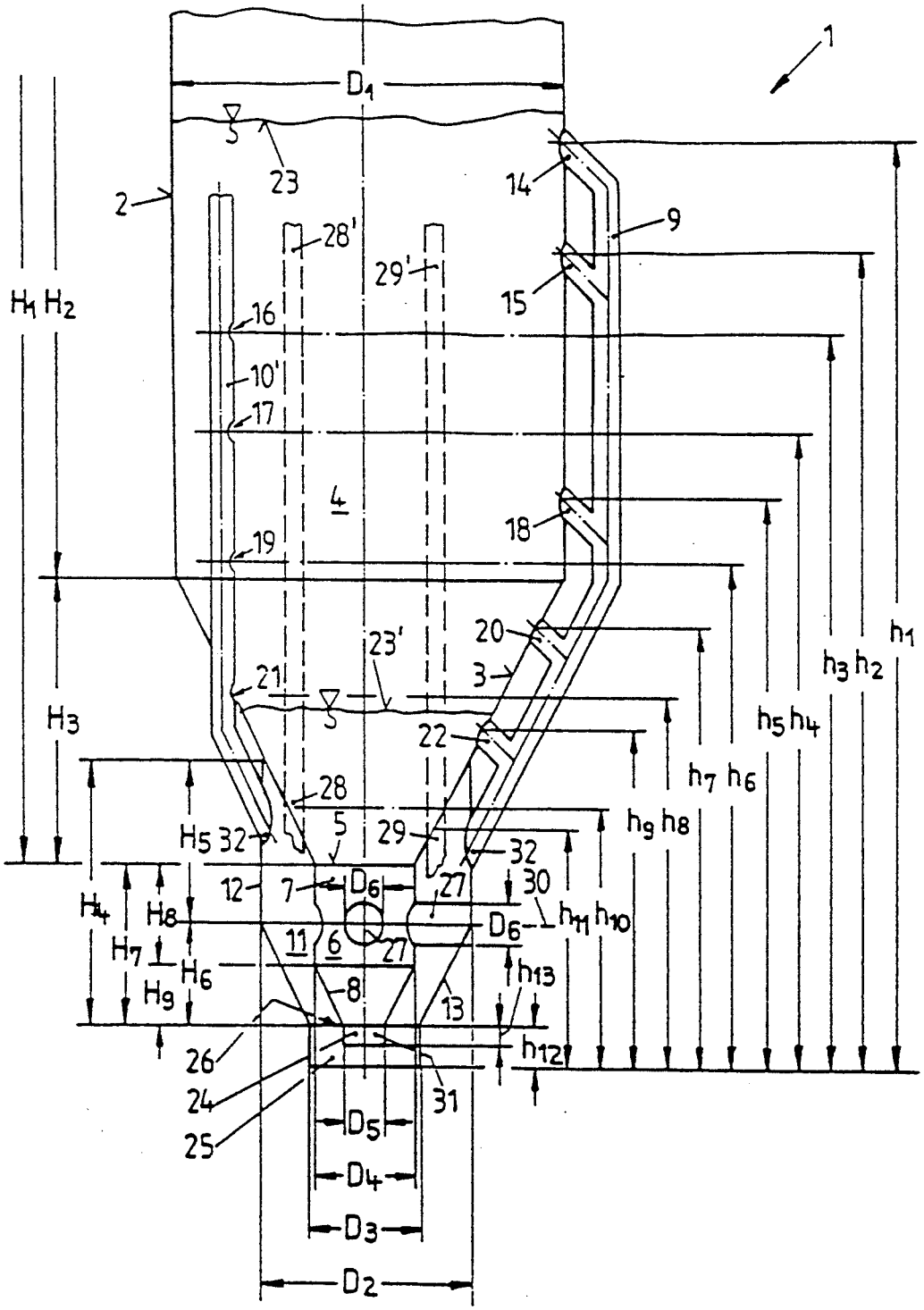
FIG. 2 shows an apparatus according to FIG. 1, with inside and outside gravity pipes.

A plurality of gravity pipes 9, 10, lying on the outside in FIG. 1, is provided in a manner known per se for the discharge of bulk material from the upper mixing container 2, although only two opposite gravity pipes are shown in FIG. 1. In FIG. 2, instead of the gravity pipe 10 running outside the mixing container 2 as in FIG. 1, a gravity pipe 10', which is representative of many such, preferably concentrically arranged, gravity pipes, is shown arranged inside the mixing container 2. The design, which is in principle the same, and the corresponding mode of operation are described below with reference to the device according to FIG. 1, insofar as they correspond.

The gravity pipes 9, 10, 10' arranged inside or outside the first, upper mixing device 4 open—possibly by means of outlet aperture 32—into a second, lower mixing device 11, which also comprises an upper cylindrical or prismatic mixing container 12, which is described below as the outer or lower discharge compartment 12, and to which a lower mass hopper 13, called the outer or lower discharge hopper 13 below, is connected. The two mass flow hoppers 8 and 13 in this case have the same hopper wall gradient.

A third, inner mixing device 6, in turn comprising an upper cylindrical or prismatic mixing container 7 and a mass flow hopper 8 connecting thereto, is connected to the first mixing device at the lower outlet 5 of the hopper 3. In the text which follows the upper mixing container 7 is called the inner discharge compartment 7 with inner discharge hopper 8. The inner discharge compartment 7 has a height $H_8$, and the inner discharge hopper 8 has a height $H_9$; the overall height of this third, inner mixing device 6 is $H_7$. The third, inner mixing device 6 is consequently surrounded concentrically by the second, lower mixing device 11. The third mixing device 6 serves in this case for conducting the bulk material from the lower outlet 5 of the mass flow hopper 3, while the second mixing device 11 serves initially only for conducting the bulk material from the gravity pipes 9, 10, 10'.

The gravity pipes 9, 10, 10' have bulk material discharge apertures 14 to 22 inside the upper mixing apparatus 4, arranged at the levels $h_1$ to $h_9$. The device according to the invention in this case has the number of gravity pipes 9, 10, 10' which corresponds to the desired removal of bulk material from different levels of the first mixing device 4. The top discharge aperture 14 of the gravity pipe 9 consequently lies at a level $h_1$ and at an upper bulk material level 23 removes bulk material from the level $h_1$, while the top discharge aperture 16 of the gravity pipe 10, 10' is at a level $h_3$ and in this case removes bulk material from this level $h_3$ and conducts it into the lower outer discharge compartment 12. Further gravity pipes, not shown in greater detail, with in each case their upper discharge apertures, relative to the bulk material level, likewise convey bulk material into the outer discharge compartment 12, so that bulk material is removed via the gravity pipes from the entire height of the first mixing device 4 (cf. DE 3,707,264). This also applies to the region of the mass flow hopper 3. At the same time bulk material flows through the lower hopper outlet 5 with the diameter $D_4$ into the third mixing device 6 lying below and having the same diameter $D_4$, and from there flows via the mass flow hopper 8 through the lower or bottom outlet 24 of the third mixing device 6 into the total outlet 25 of the second mixing apparatus 1. The outlet 24 has a throughflow diameter $D_5$, which behaves like a single gravity pipe. The total outlet 25 has a throughflow diameter $D_3$. The diameter of the upper mixing container 2 is indicated by $D_1$, and the diameter of the lower discharge compartment 12 by $D_2$.

When the upper mixing device 4 is full, bulk material consequently flows from each level $h_1$ to $h_n$ through the top inlet apertures of each gravity pipe below the bulk material level 23 and passes through the gravity pipes 9, 10, 10' into the lower discharge compartment 12, and from there via the mass flow hopper 13 into an annular outlet 26 arranged around the outlet 24, and from there into the total outlet 25. The outlet cross-section of outlet 26 is determined by the diameters $D_3$ minus $D_5$. At the same time bulk material flows through the outlet 5 from the mass flow hopper 3 into the inner discharge compartment 7, and from there via the mass flow hopper through the outlet 24 with the diameter $D_5$ to the outside. All mixing devices 4, 6, 11 are designed for mass flow, i.e. uniform dropping of the material takes place.

If the bulk material level 23 now falls for example to a bulk material level value 23' between $h_8$ and $h_9$, the lower discharge compartment 12 is filled only with bulk material from the gravity pipe 9, since the gravity pipe 10, 10' has no further inlet aperture below the level $h_8$. In the extreme case, i.e. bulk material level in the mass flow hopper 3 below $h_{11}$, bulk material now flows only via the outlet 5 of the mass flow hopper 3, and nothing more flows through the annular outlet 26. In this case only the lower outlet 24 with the diameter $D_5$ would then be operative, and it would then behave like a single gravity pipe and allow through considerably less bulk material than the total cross-section of the outlets 24 and 26 permitted. The outflow time of the mixing device 4 would consequently increase greatly, or the desired discharge mass flow could no longer be reached. Provision is therefore made according to the invention for the cylindrical surface of the inner discharge compartment 7 to have a series of outlet bores or apertures 27 below the gravity pipe outlet apertures 32 (or 28, 29), through which the bulk material from the inner discharge compartment 7 can then flow out if the surrounding discharge compartment 12 is no longer filled or is no longer filled completely with bulk material from the gravity pipes 9, 10, 10'. The bulk material coming out of the outlet 5 can then also pass, via the bores 27, into the outer discharge compartment 12, and from there reach the annular outlet 26, so that material flows through the full lower outlet cross-section 25 of the outlets 24, 26 even when bulk material is now only flowing through the outlet 5 of the mass flow hopper 3. In this case, however, the cross-section area of outlet 5 must be equal to or greater than the lower total outflow area of the total outlet 25.

The total cross-section of the passage bores 27 on the cylindrical surface of the inner discharge compartment 7 is dimensioned in such a way that approximately the amount of material corresponding to the maximum throughput of bulk material through the annular outlet 26 (i.e., the annular area of the outlet 26, surrounding the bottom outlet 24 in an annular manner) can pass out through said cross-section.

Further short gravity pipes in the levels $h_{10}$, $h_{11}$ are indicated by reference numbers 28, 29, which pipes convey bulk material from the bottom layers of the mass flow hopper 3 into the outer discharge compartment 12.

The lower second mixing device (11) is connected to the mixing device 4 approximately in the lower half or in the lower third of the mass flow hopper 3. It is in principle designed in such a way that all gravity pipes 9, 10, 10' open into it, the gravity pipes either opening laterally into the outer discharge compartment 12 through outlet apertures 32 or—if the gravity pipes are situated inside the diameter region $D_2$ in the upper mixing device 4—penetrating the mass flow hopper 3 vertically. The short gravity pipes 28, 29 can therefore also be normal gravity pipes 28', 29' (see FIG. 2).

The cylindrical or prismatic lower discharge compartment 12 extends approximately to the horizontal central plane 30 of the bulk material outlet apertures 27. The mass flow hopper 13 connecting thereto extends to the lower end of the overall apparatus, where the cylindrical total outlet 25 with height $h_{12}$ is provided. The mass flow hopper 8 also has a cylindrical outlet attachment 31 with height $h_{13}$, which is arranged slightly displaced into the interior of the outlet 25. All gravity pipes 9, 10, 10' must open out above the outlet apertures 27 of the inner discharge compartment 7 in the lower discharge compartment 12, so that the bulk material flow in the lower discharge compartment 12 is initially determined only by the bulk material from the gravity pipes.

Diverging from the drawing, the diameter $D_4$ of the outlet 5 of the mass flow hopper 3 is selected equal to or larger than the diameter $D_3$ of the lower outlet 25 ($D_4 \geqq D_3$), since the &total outflow quantity of bulk material without gravity pipes through the outlet of the cross-section 5 is determined by it.

The cross-section of the outlet 5 is in this case selected so large that the desired total mass flow can pass through. This is the case when all gravity pipes are not active and the total mass flow flows off through the apertures 27 and the outlet 24.

The area ratio between the outlet aperture of the annular outlet 26 and the bottom outlet 24 of the hopper 8 is selected in such a way that it corresponds to the area ratio of all gravity pipes 9, 10, 10', 28, 29 to a single gravity pipe. This makes the outlet 24 behave like a single gravity pipe. [$F_{26}:F_{24}=F$ (total gravity pipes):F (single gravity pipe)]. If there are, for example, twenty gravity pipes, the ratio of the area of annular outlet 26 to the area of bottom outlet 24 equals 20.

The invention is not limited to the exemplary embodiment illustrated and described. On the contrary, it covers all expert further developments and designs without their own inventive content.

What I claim is:

1. An apparatus for mixing powdered or coarse-grained bulk materials or solids, having an upper mixing device (4) which includes a cylindrical or prismatic upper mixing container (2) and a tapering mass flow hopper (3) with a hopper outlet (5) connected thereto, and having a lower mixing device (11) which is connected to the upper mixing device (4) and which includes an upper cylindrical or prismatic mixing container (12) and a downward tapering mass flow hopper (13) connected thereto, and having a plurality of spaced-apart gravity pipes (9, 10, 10'), each with a plurality of discharge apertures (14-22) which are arranged at various levels and which each convey bulk material from different levels of the upper mixing device (4) to the lower mixing device (11), the gravity pipes (9, 10, 10') being situated radially outside the outlet cross-section of the hopper outlet (5) of the upper mixing device (4) and having outlet apertures (32) which open into the lower mixing device (11), characterized in that:

connected downstream of the hopper outlet (5) of the upper mixing device (4) is an inner mixing device (6) which includes an upper cylindrical or prismatic mixing container (7) and a downward tapering mass flow hopper (8) connected thereto, the inner mixing device (6) being surrounded by the lower mixing device (11); and the mixing container (7) of the inner mixing device (6) has outlet apertures (27) into the lower mixing device (11) and from which bulk material flows when the mixing container (12) of the lower mixing device (11) is not completely loaded with bulk material from the gravity pipes, the outlet apertures (27) in the mixing container (7) of the inner mixing device (6) being disposed below all of the gravity pipe outlet apertures (32), the bulk material in all three mixing devices (4, 6, 11) dropping uniformly downwards.

2. An apparatus according to claim 1, characterized in that the mass flow hopper (13) of the lower mixing device (11) has an annular outlet (26), the total cross-sectional area of all gravity pipe outlet apertures (32) corresponding approximately to the cross-sectional area of the annular outlet (26) of the mass flow hopper (13) of the lower mixing device (11).

3. An apparatus according to claim 1, characterized in that the mixing container (12) of the lower mixing device (11) is formed in such a way that the outlet apertures of all gravity pipes (9, 10, 10', 28, 29) in it open out above the bulk material outlet apertures (27) from the mixing container (7) of the inner mixing device (6).

4. An apparatus according to claim 1, characterized in that the bulk material outlet apertures (27) in the mixing container (7) of the inner mixing device (6) have aperture centers that are disposed approximately in a horizontal center plane (30), and the container compartment (12) of the lower mixing device (11) is connected to the lower half of the mass flow hopper (3) of the upper mixing device (4) and extends approximately to the horizontal central plane (30).

5. An apparatus according to claim 1, characterized in that the mass flow hopper (8) of the lower mixing device (6) has an outlet (24), and the mass flow hopper (13) connected to the container compartment (12) of the lower mixing device (11) has an annular outlet (26) that is disposed at approximately the same level as the outlet (24) of the mass flow hopper (8) of the lower mixing device (6).

6. An apparatus according to claim 2, characterized in that the mass flow hopper (8) of the inner mixing device (6) has a bottom outlet (24), and the apparatus (1) has a total outlet (25) that is formed by the outlet (24) of the mass flow hopper (8) of the inner mixing device (6) plus the annular outlet (26) of the mass flow hopper (13) of the lower mixing device (11).

7. An apparatus according to claim 6, characterized in that the cross-section of the hopper outlet (5) of the upper mixing device (4) is at least as large as the cross section ($D_3$) of the total outlet (25) of the apparatus (1).

8. An apparatus according to claim 2, characterized in that the mass flow hopper (8) of the inner mixing device (6) has a bottom outlet (24), and the area ratio between the annular outlet (26) of the mass flow hopper (13) of the lower mixing device (11) and the bottom outlet (24) of the mass flow hopper (8) of the inner mixing device (6) corresponds to the area ratio of all gravity pipes (9, 10, 10', 28, 29) to a single gravity pipe (9).

9. An apparatus according to claim 2, characterized in that the mass flow hopper (13) of the lower mixing device (11) has a hopper wall gradient, and the mass flow hopper (8) of the inner mixing device (6) has a hopper wall gradient that is equal to the hopper wall gradient of the mass flow hopper (13) of the lower mixing device (11).

* * * * *